US005484310A

United States Patent [19]

McNamara et al.

[11] Patent Number: 5,484,310

[45] Date of Patent: Jan. 16, 1996

[54] SHIELDED ELECTRICAL CONNECTOR

[75] Inventors: David M. McNamara, Lyndeborough; Daniel B. Provencher, Weare, both of N.H.; Philip T. Stokoe, Attleboro, Mass.; William E. Howard, New Boston, N.H.; Mark W. Gailus, Somerville, Mass.

[73] Assignee: Teradyne, Inc., Boston, Mass.

[21] Appl. No.: 399,393

[22] Filed: Mar. 6, 1995

Related U.S. Application Data

[62] Division of Ser. No. 43,195, Apr. 5, 1993, Pat. No. 5,403,206.

[51] Int. Cl.[6] ..... H01R 13/658

[52] U.S. Cl. ..... 439/608; 439/108; 439/607

[58] Field of Search ..... 439/101, 108, 439/571, 573, 607, 608

[56] References Cited

U.S. PATENT DOCUMENTS

| | | | |
|---|---|---|---|
| 3,957,337 | 5/1976 | Damiano | 439/682 |
| 4,558,917 | 12/1985 | Kamono et al. | 439/608 |
| 4,611,867 | 9/1986 | Ichimura et al. | 439/101 |
| 4,806,109 | 2/1989 | Manabe et al. | 439/108 |
| 4,846,727 | 7/1989 | Glover et al. | 439/608 |
| 4,898,546 | 2/1990 | Elco et al. | 439/608 |
| 4,914,062 | 4/1990 | Voltz | 439/608 |
| 4,975,084 | 12/1990 | Fedder et al. | 439/608 |
| 5,055,069 | 10/1991 | Townsend et al. | 439/608 |
| 5,133,679 | 7/1992 | Russelman et al. | 439/608 |
| 5,135,405 | 8/1992 | Russelman et al. | 439/108 |
| 5,310,354 | 5/1994 | Oswald, Jr. | 439/608 |

FOREIGN PATENT DOCUMENTS

| | | |
|---|---|---|
| 422785 | 4/1991 | European Pat. Off. . |
| 520283 | 12/1992 | European Pat. Off. . |
| 561202 | 9/1993 | European Pat. Off. . |

*Primary Examiner*—Gary F. Paumen

[57] ABSTRACT

Electrical connectors are provided with shield units each having a plurality of shields joined by a bridge. Preferably the shield units are mounted in a base stiffened by means apertured to carry mounting ear means.

25 Claims, 6 Drawing Sheets

SHIELDED ELECTRICAL CONNECTOR

This application is a division of application Ser. No. 08/043,195, filed Apr. 5, 1993, now U.S. Pat. No. 5,403,206 issued Apr. 4, 1995.

FIELD OF THE INVENTION

This invention relates to board electrical connectors, and more particularly to such connectors in which signal pins are shielded.

BACKGROUND OF THE INVENTION

Shielding pins in a board electrical connector is known to be desirable: for example, Glover et al. U.S. Pat. No. 4,846,727 and Fedder et al. U.S. Pat. No. 4,975,084.

SUMMARY OF THE INVENTION

We have discovered that an improved board electrical connector may be provided by mounting, in a base in which are mounted signal pins a shield unit comprising a plurality of shields and means for interconnecting at least one board and another device outside the connector.

In preferred embodiments, there is provided a molded plastic insulating base with, extending in a grid extending longitudinally of said length and across a shorter transverse width a grid of a multiplicity of small holes with signal pin receptacles mounted therein and a multiplicity of H-shaped holes with shield units mounted therein, the shield units including two conductive shields, each carrying a pin receptacle centrally transversely thereof, and extending over the signal pins therebetween, the two shields being electrically connected through an integral conductive bridge integral also with a shield pin, the shield pins being adapted to engage a daughter board in a pattern shared by the signal pins, and the shield unit receptacles being adapted to engage a backplane connector element pin in a pattern shared by the signal pins, the shields being apertured and the base being secured to the daughter board through a stiffener extending along one side of the base and secured through tabs thereon in base receptors and cooperating through keyhole apertures with ears slidably mounted therein and fastened to the daughter board.

PREFERRED EMBODIMENTS

There follows a description of preferred embodiments, in structure and operation.

Drawings FIG. 1 is an exploded, broken away, isometric view of a shield unit according to the invention.

FIG. 6(*b*) is a bottom elevational view of the element of FIG. 6(*a*).

STRUCTURE

Figure 1:
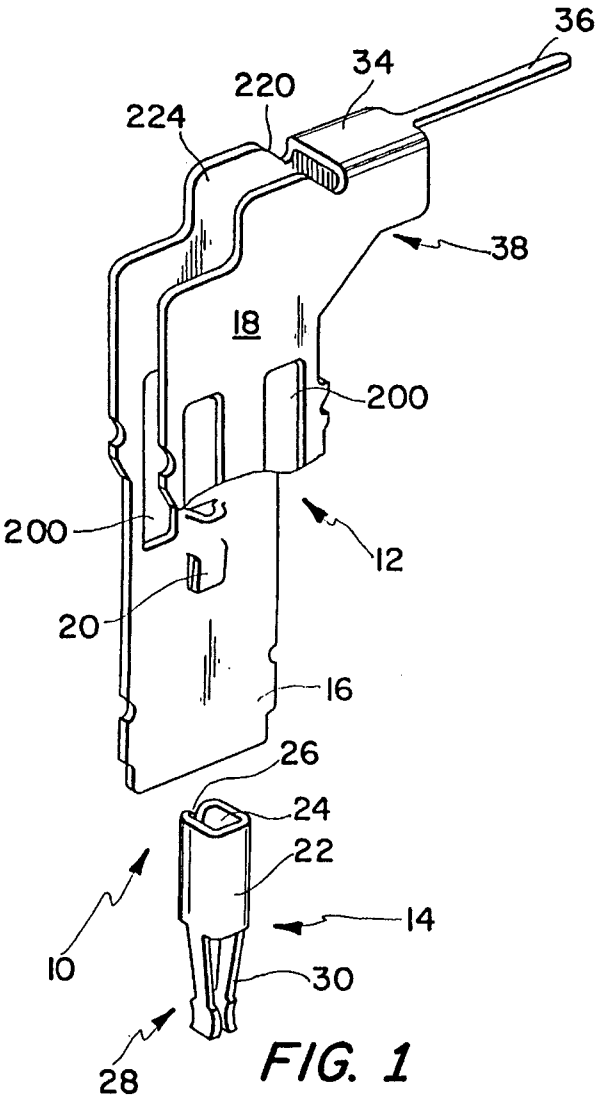

Referring to FIG. 1, there is shown a shield unit according to the invention, indicated generally at 10. Shield unit 10 includes a shielding portion, indicated generally at 12, and a contact portion, indicated generally at 14.

Shielding portion 12 includes correspondingly externally configured shields 16 and 18 (the latter shown with its lower portion broken away). Formed integrally with shields 16 and 18, by slitting and forming, are receptacle holders 20 (not shown on shield 18 because that shield is broken away), opposingly located to each secure against its shield thereat a contact portion 14 formed from a single sheet of conductive metal to provide an upper held portion 22 (in cross-section a sort of hollow square 24, abutting metal edges thereof being located along a line 26), held on opposing sides of portion 22 by the two receptacle holders 20 of a unit 10, and a lower receptacle indicated generally at 28 and with a pair of cantilevered spring contact arms 30 for being springingly urged apart by a cooperating contact pins, as will be seen. Extending between shields 16, 18 is an integral therewith bridge 34 from which integrally extends ground contact pin 36. Bridge 34 defines with shields 16 and 18 a portion indicated generally at 38 which is upsidedown-U-shaped in cross-section.

Figure 2:
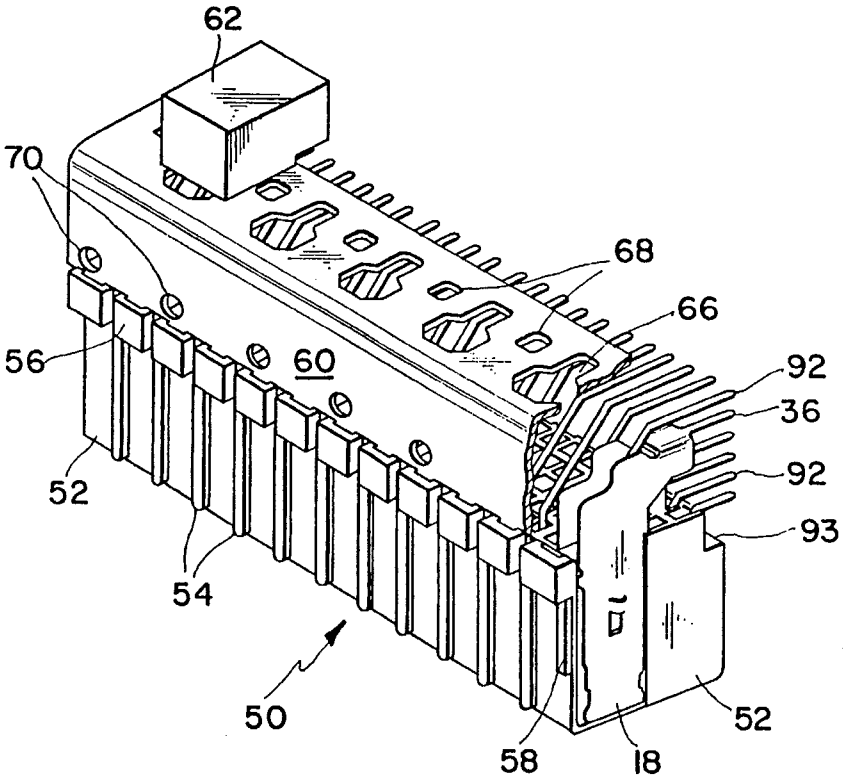
FIG. 2 is an isometric view, partially broken away, of the daughter board connector element of a preferred embodiment of the invention.

In FIG. 2 is indicated generally at 50 a daughter board connector element according to the invention.

This element 50 includes a base 52 of injection molded plastic having molded integrally therein a multiplicity of alinement ribs 54 on each side thereof, and a multiplicity of tab receptors 56 on one side thereof. Also molded therein is shortened rib 58.

Mounted on element 50 are stiffener 60 and mounting block 62.

Figure 4:
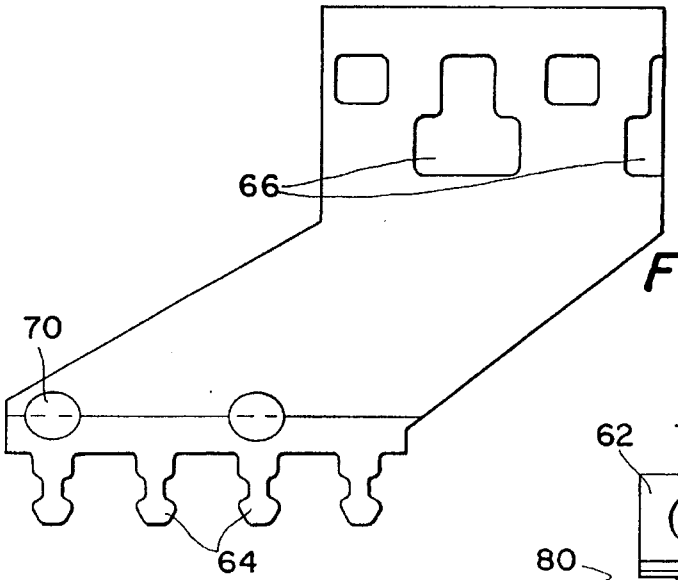
FIG. 4 is a partial plan view of an unbent blank suitable to be formed into an element of the embodiment of FIGS. 2 and 3.

Stiffener 60 is formed of sheet stainless steel and includes a multiplicity of tabs 64 (FIGS. 4 and 5, the former showing the blank strip later formed into the stiffener of FIGS. 2 and 5). Stiffener 60 includes a multiplicity of each of keyhole holes 66, square holes 68, and round holes 70.

Figure 6A:
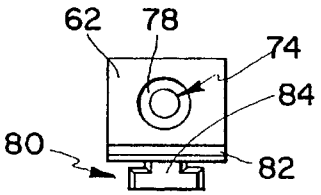
FIG. 6(*a*) is an end elevational view of an element of the subassembly of FIG. 5.
Figure 6B:
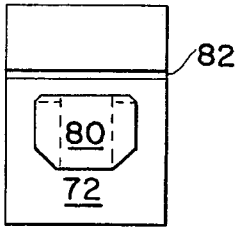
Figure 5:
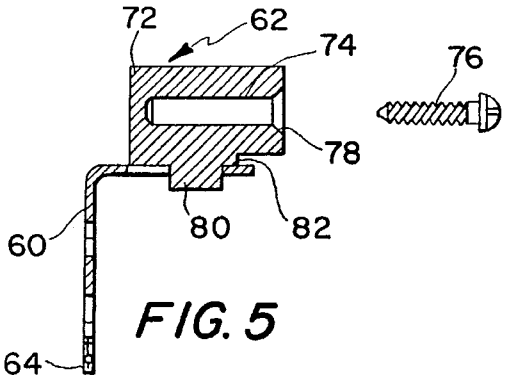
FIG. 5 is an exploded view, partially in section, of a subassembly of the embodiment of FIGS. 2 and 3.

Mounting ear 62 (indicated generally at 62, and shown in more detail, in FIG. 5) includes body 72 in which extends internally threaded portion 74 for engagement with fastener 76 and including countersink 78 and a shank indicated generally at 80 in FIGS. 5, 6(*a*), and 6(*b*). Extending across body 72 is step 82. Shank 80 is T-shaped (FIG. 6(*a*)), with chamfers on its side and top edges of its portion 84 spaced from body 72.

Figure 3:
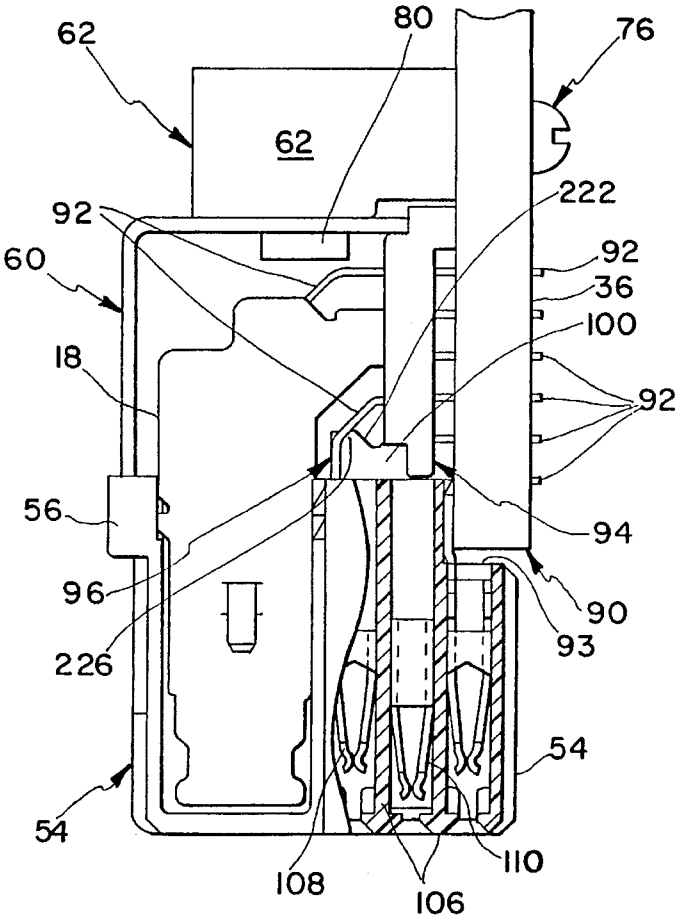
FIG. 3 is an end elevational view, partially broken away, of the embodiment of FIG. 2.

There is shown in FIG. 3 daughter board 90, held against mounting block 62 by fastener 76. Extending through daughter board 90 are ground pins 36 and signal pins 92. Base 52 is provided with longitudinal notch 93 to accommodate daughter board 90. The pins extend also through guide 94.

Figure 8:
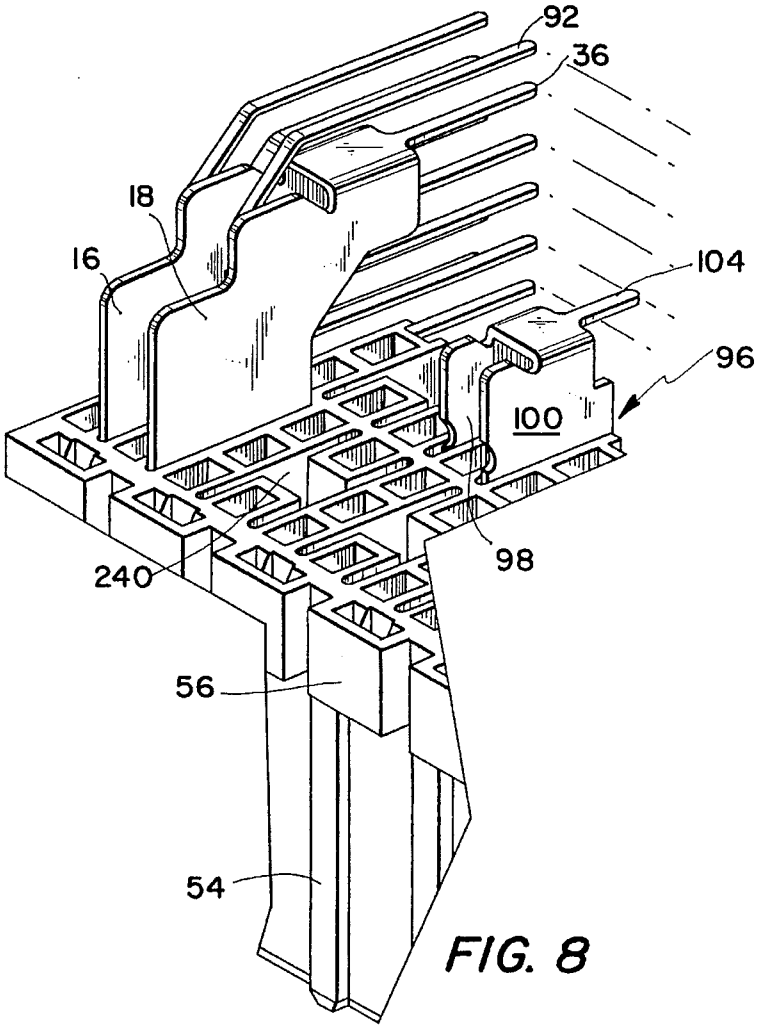
FIG. 8 is an isometric view, broken away, of an end portion of a subassembly of the embodiment of FIGS. 2 and 3.
Figure 7:
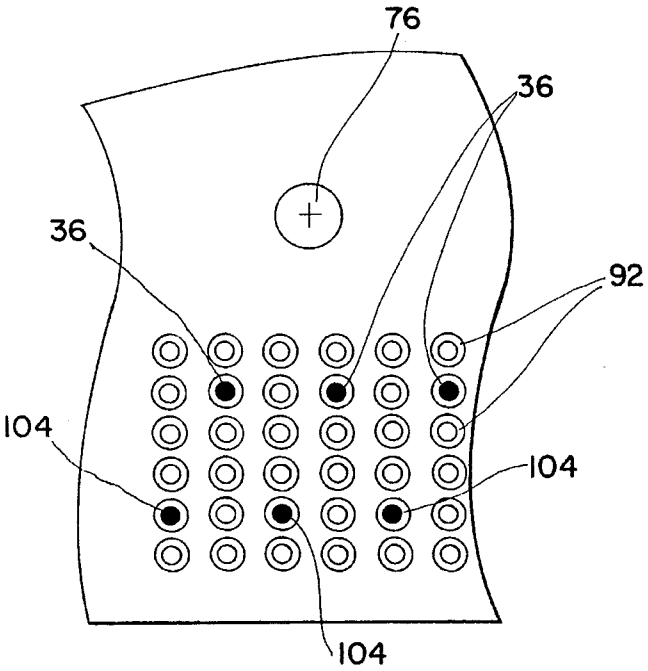
FIG. 7 is a partial, somewhat diagrammatic, side view of a portion of the daughter board element shown in FIG. 3.

A shield unit, of different, shorter configuration than shield unit 10, is shown at 96 (and indicated generally at 96 in FIG. 8). The unit 96 includes a pair of shields 98, 100 each carrying (not shown) a lower receptacle 28 just as does unit 10. Ground pins 104 extending through the daughter board from shield units 96 extend in alternate vertical rows, always in this embodiment in the second horizonal row from the bottom, as diagrammatically shown in FIG. 7, in which are shown unit 96 ground pins 104, unit 10 ground pins 36 (all darkened for diagrammatic ease of understanding), and (undarkened) signal pins 92 (shown in FIG. 3 in a vertical row not including a ground pin 104); as here, ground pins 36 occur also in alternate vertical rows, those not including ground pins 104.

Integral with the rest of base 52 are walls 106 separating various receptacles; shown in FIG. 3 are signal receptacles 108 and ground receptacle 110 (which is mounted on shields 98, 100 of shield units 96 (mounting not shown, but as in FIG. 1)). These walls extend in a grid in both transverse (as shown in FIG. 3) and longitudinal directions (as shown in FIG. 2).

Figure 10:
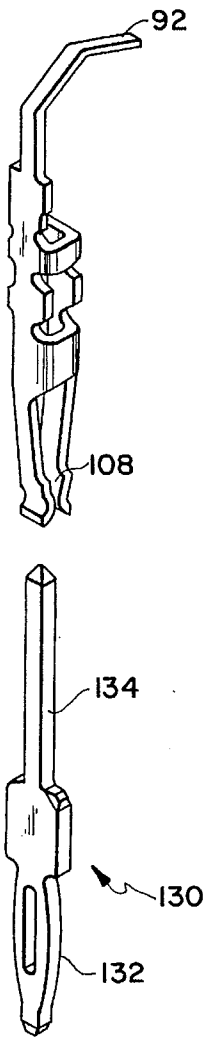
FIG. 10 is an exploded isometric view of a daughter board connector receptor element with integral signal pin and a backplane connector element pin for cooperation therewith in a preferred embodiment of the invention.
Figure 9:
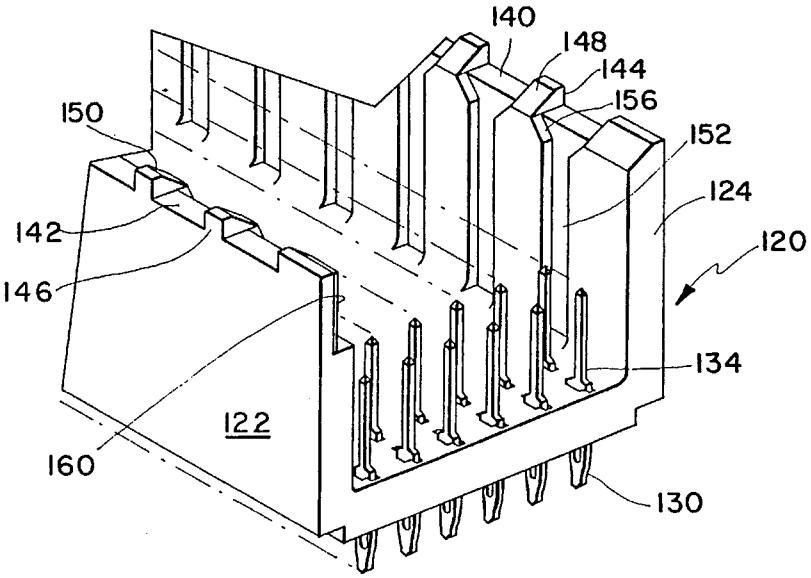
FIG. 9 is an isometric view, broken away, of a backplane connector element useful in a preferred embodiment of the invention.

There is shown in FIG. 9 a backplane connector element 120 of a preferred embodiment. A base portion 126 is integrally injection molded of plastic with side portions 122 and 124. Mounted in holes in bottom 126 are dynamic pins 130 (FIG. 10), which include dynamic end 132 for engaging a backplane (not shown) and contact portion 134 for engaging receptacle 108.

Each side wall 122, 124 includes correspondingly longitudinally positioned and sized notches 140,142 to receive tab acceptors 56. Between notches 140, 142 extend upwardly therefrom longitudinally shorter protuberances 144, 146 with downwardly, inwardly slanting surfaces 148, 150. Downward from notches 140 extend alinement grooves 152, correspondingly sized and located inside sides 122, 124, to accept alinement ribs 54 and rib 58. Slanted surfaces 156 extend from the bottoms of protuberances 144, 146 to grooves 152. Notch 160 provides clearance for rib 58 (FIG. 2).

Rectangular apertures 200 are provided in shields 16, 18 and (not shown) 98, 100, for capacitance adjustment. Each of the four shields is of 5 mm. transverse dimension at its portion which includes rectangular holes 200. Each of the holes 200 is one millimeter in that width direction and two millimeters in its vertical direction; the wall spacing them is two millimeters in width. Holes 200 are not shown in FIGS. 3 and 8.

Notches 220, 222 permit respectively portions 224, 226 to extend upwardly farther for greater signal pin area shielding (FIGS. 1 and 3).

Shield units 10, 96 are received in H-shaped slots 240 (FIG. 8). One shield of a shield unit fits in each thin leg of the H. The contact portion 14 extending between a pair of shields of a shield unit extends through that portion of the wide cross-bar of the H not occupied by a thin shield portion. As shown in FIG. 8, the thin legs of the H-shaped slots 240 run between adjacent rows of holes which receive receptacles 108 (FIG. 3). Thus, the thin legs of H-shaped slots run between adjacent rows of the conductive members (receptacles 108 in the preferred embodiment) in daughter card connector element 52. As shown in FIG. 8, between each adjacent row of receptacles, there will be two plates: 1) either plate 16 or plate 18 of shield unit 10; and 2) a plate 98 from shield unit 96. Also as shown in FIG. 8, these plates are mounted in line with each other.

Figure 11:
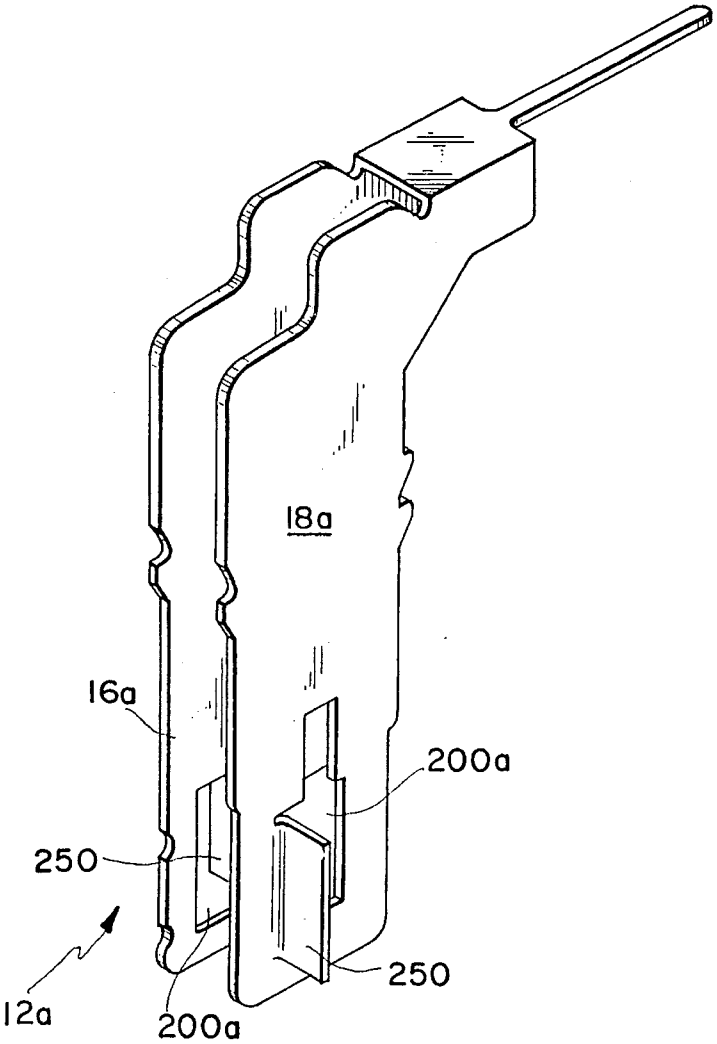
FIG. 11 is an isometric view of a modified embodiment of the shield unit of the invention.

FIG. 11 illustrates a modification of the shield unit 12*a* of the invention in which the metal of shields 16*a*, 18*a* is cut on three sides of apertures 200*a*, the peninsular metal then being folded out perpendicularly to provide tab shields 250 shielding between (FIG. 12) certain pins, for portions of their heights corresponding to the vertical extents of tabs 250.

Figure 13:
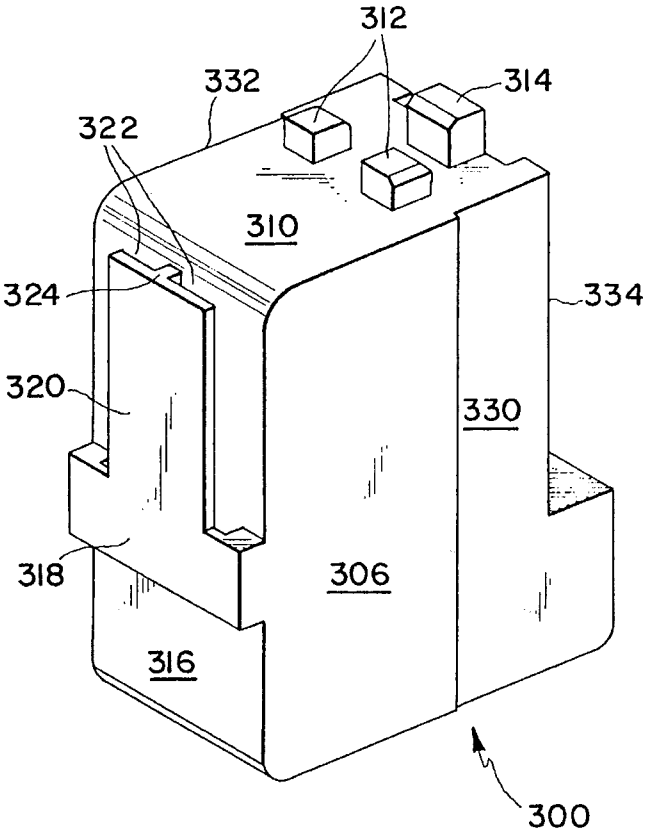
FIG. 13 is an isometric view of a stiffener coupler of the invention.

FIG. 13 illustrates a coupler unitarily injection molded of plastic and useful to mount two stiffeners, not only relative to other portions of their respective modules but to each other as well. Coupler 300 body 306 includes top surface 310 from which protrude two generally cubical protuberances 312 and a higher rectangular protuberance 314. The protuberances 312 are sized and spaced to fit with stiffener square holes 68 and/or the three-sided-square portions of keyholes 66 (FIG. 2). From front surface 316 extends shelf 318, centrally upwardly of which extends receptor 320 defining with body 306 a pair of slots 322 sized to accept respectively the ends of a pair of stiffeners 60. Between slots 322 is ridge 324 which includes a pair of abutment surfaces 326. Shelf 318 includes a pair of tab receptor holes 328.

Notches 330, 332, and 334 are provided for interfitting, as will be seen.

Figure 14:
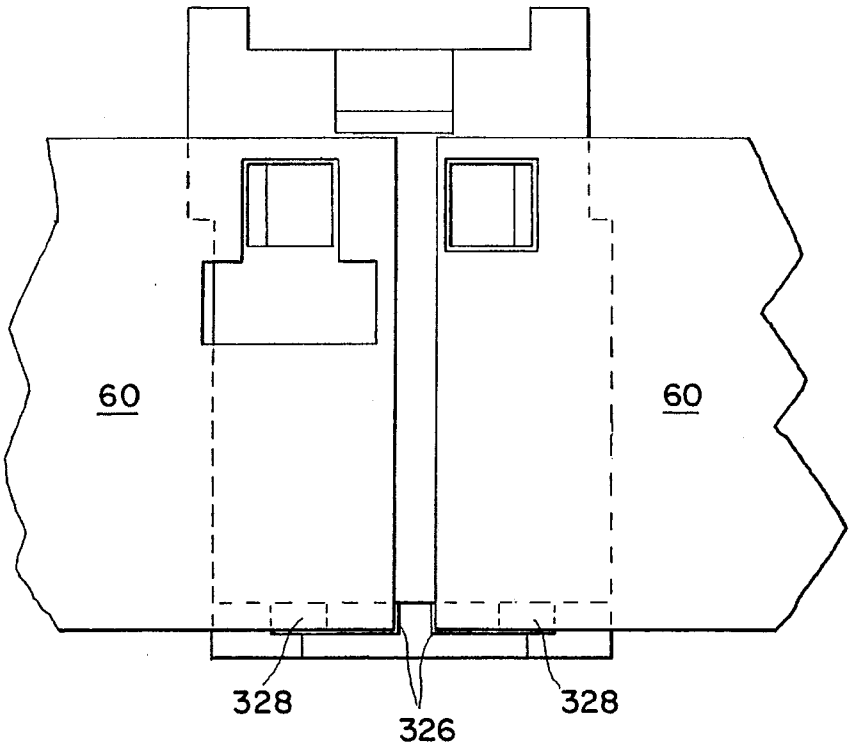
FIG. 14 is a plan view of the coupler of FIG. 13, showing portions of two adjacent stiffeners.

As shown in FIG. 14, stiffener 60*a* and 60*b* have ends disposed in slots 322, their end edges abutting abutment surfaces 326, their bottom surfaces abutting shelf 318, and their side surfaces abutting protuberance 314.

Operation

Stiffener 60 serves as a locator modules, not all of which embody the invention, being multiplexed. When mounting is with ear 62, flange 80 is inserted through the largest, generally rectangular, portion of keyhole 66 (FIGS. 5 through 6(*b*)), and them moved so that the edges of the smaller portion of hole 66 are in the slot defined between 84 and 62 of the ear. (An alternative, less presently preferred keyhole configuration is shown in FIG. 2) Square holes 68 permit, if desired cooperatively with the small, generally square, parts of keyholes 66, mounting suitably sized modules, as for power supply, beneath rather than above stiffener 60, to conserve space. Round holes 70 facilitate cleaning during manufacture; thus, after soldering, solutions and air blowing may be used to clean the assembly inside the stiffener.

The stiffener functions with connector elements to facilitate accuracy and ease of positioning properly the latter and other elements, if desired. Stiffener configuration increases usable are and enhances card flatness control.

The shields reduce inductive and capacitive crosstalk, and act as low inductance ground return paths to affect signal path impedance and reduce switching noise. They enhance signal integrity.

Provision of holes 200 allows tuning of capacitance of and inductance between shields (16 and 18) and between adjacent signal pins.

Shields of shield units may be extended downward to shield pins within the backplane.

Providing a shield 18 outboard of base 52 gives shielding between modules (FIGS. 2 and 3). A shield (not shown) is similarly positioned on the opposite longitudinal end and opposite side of the module.

Figure 12:
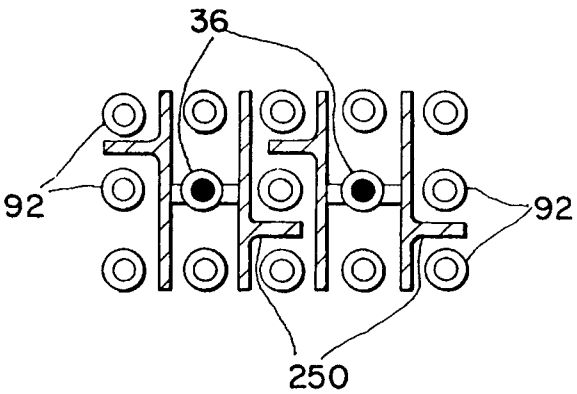
FIG. 12 is a diagrammatic partial sectional view taken on a horizontal slice through the embodiment of FIG. 11, along a plane about halfway up the bent-out shield portions perpendicular to the shield apertures.

Striking out tabs shields, as shown in FIGS. 11 and 12, valuably provides for additional direction shielding.

Using the coupler illustrated in FIGS. 13 and 14 provides simply for module and stiffener alignment and enhances structural integrity.

Other Embodiments

Other embodiments of the invention will occur to those skilled in the art.

Single module embodiments, as shown in the figures and described, may be multiplexed, as long a single stiffener, along which may be mounted not only embodiments of the shielding invention but as well other modules, such as power supply modules and guidance modules to assist in orientation of other modules.

Mounting ears may be of metal, and serve the additional function of ground conduit.

The plastic housing surrounding the daughter board connector element may completely enclose the outermost shields or shield.

Metal struck from shields in making apertures may be bent out from shield main bodies in order to provide further shielding.

The spring contact arms on a shield may be made integral with the main body of the shield—stamped out thereof and formed.

Level of capacitive and inductive shielding, as well as impedance of signal paths, may be varied by changing the number, size, and placement of shield apertures, as well as material and spacing of shields.

A shield unit may be used to transmit power input rather than as a ground.

Identical backplane and daughter board contacts, and connector element contacts for both, may be used to engage both signal pins and ground pins. A consistent footprint or pattern of ground and signal connections, for ease of user understanding and use, is thus made possible.

High signal pin density is possible, and achieves increased signal integrity with fewer reference position connections.

Shield contact receptacles may be formed integrally with their shields. They may be so formed to cooperate with blades, as disclosed in the commonly assigned application of Provencher et al., "Power Connector", filed Mar. 31, 1993, which is now U.S. Pat. No. 5,360,349.

We claim:

1. A connector for electrical signals of the type having a first housing and a second housing having openings therein and being adapted to be mated to the first housing, comprising:

a) a first plurality of conductive members attached to said first housing, each of said conductive members having a projecting portion disposed to project into an opening in the second housing when the first and second housings are mated, with the projecting portions disposed in a rectangular array having a plurality of adjacent rows with the same number of conductive member in each row;

b) a second plurality of conductive members, each disposed within an opening in the second housing, each of the second plurality of conductive members disposed to make contact with a projecting portion of at least one of the first plurality of conductive members when the first and second housings are mated; and c) at least one conductive sheet mounted in the second housing and disposed between two adjacent rows of the projecting portions when the first housing and second housing are mated, said conductive sheet being attached to at least one of the conductive members of the second housing.

2. The connector of claim 1 wherein the at least one conductive sheet is mounted in an opening in the second housing.

3. The connector of claim 1 wherein the at least one conductive sheet comprises at least two conductive sheets, with pairs of conductive sheets attached to the same one of the second plurality of conductive members.

4. The connector of claim 3 wherein each sheet in each pair of conductive sheets attached to the same one of the second plurality of members are joined by a conducting bridge.

5. The connector of claim 4 additionally comprising a conducting pin attached to the bridge and extending outside the first and the second housings.

6. The connector of claim 1 wherein the conductive member to which the conductive sheet is attached is one of the second plurality of conductive members.

7. The connector of claim 1 wherein the plurality of first conductive members comprises a plurality of identical member arranged in a rectangular array having a plurality of rows.

8. The connector of claim 7 wherein the plurality of identical members comprise pins.

9. The connector of claim 7 wherein the at least one conductive sheet comprises a first plurality of conductive sheets, each conductive sheet disposed between adjacent rows of the array of first conductive members.

10. The connector of claim 9 additionally comprising a second plurality of conductive sheets, each one of the second plurality of conductive sheets being mounted between adjacent rows of the array of first conductive members in line with one of the first plurality of conductive sheets.

11. The connector of claim 10 wherein a first conductive sheet between two adjacent rows of first conductive members is electrically connected to a first conductive member in a first of the two adjacent' rows and a second conductive sheet between the same two adjacent rows is electrically connected to a first conductive member in a second of the two adjacent rows.

12. The connector of claim 1 wherein:

a) a portion of the second plurality of conductive members have tails extending from the second housing, the tails extending from the second housing in a plurality of rows; and b) the at least one conductive sheet comprises a plurality of conductive sheets, each disposed between adjacent rows of the projecting portions; and c) each of the conductive sheets includes a portion extending from the second housing between adjacent rows of tails.

13. The connector of claim 12 wherein pairs of the plurality of conductive sheets are attached to the same one of the second plurality of conductive members.

14. The connector of claim 13 wherein the first plurality of conductive members are pins and the second plurality of conductive members are pin receptacles.

15. The connector of claim 14 wherein each pair of conductive sheets attached to the same one of the second plurality of conductive members is formed from one conductive sheet bent into two parallel sheets joined by a bridge.

16. A printed circuit board assembly using the connector of claim 1 comprising:

a) a first printed circuit board having the first housing mounted thereto;

b) a second printed circuit board having the second housing mounted thereto; and c) wherein the conductive member to which the conductive sheet is attached is a ground.

17. An electrical connector adapted to be mounted to a circuit board comprising:

a) an insulative housing having a first surface and a second surface, the second surface having a plurality of openings therein and the openings being disposed in a rectangular array having a plurality of rows;

b) a plurality of signal contacts mounted in the insulative housing to occupy a portion of the openings, and each of the signal contacts having tail portions adapted to be mounted to the circuit board extending from the insulative housing and through a plane that is parallel with the first surface; and c) a plurality of conductive plates mounted in the insulative housing, each disposed between two adjacent rows of openings, with at least two of said plates disposed between a pair of adjacent rows, with each of said two conductive plates having a length in the direction of the rows which is less than the length of the rows.

18. The electrical connector of claim 17 wherein the two plates between a pair of adjacent rows each have conductive tails extending therefrom and through the plane that is parallel with the first surface.

19. The electrical connector of claim 17 wherein one of the two plates between a pair of adjacent rows has a portion extending out of the insulative housing and extends above the second of the two plates between a pair of adjacent rows.

20. A connector for electrical signals comprising:

a) a housing having a plurality of openings formed therein, at least a portion of said openings being of the same size and being disposed in at least two rows;

b) a first plurality of receptacles, each mounted in an opening in a row of openings and each comprising:

i) a compliant portion adapted to engage a pin inserted in an opening; and ii) a tail portion extending beyond the housing;

c) at least one conductive plate having a first portion inserted between the rows of openings in the housing; and d) at least one additional receptacle mounted in an opening in a row of openings, said additional receptacle having a compliant portion adapted to engage a pin inserted in a said opening and being attached to the at least one conductive plate.

21. The connector for electrical signals of claim 20 additionally comprising a conductive pin extending from the conductive plate.

22. The connector for electrical signals of claim 20 wherein each of the first plurality of receptacles comprises a bent portion between the compliant portion and the tail portion.

23. The connector of claim 22 wherein the conductive pin extending from the conductive plate is parallel to the tail portion of the first plurality of receptacles.

24. The connector of claim 20 wherein the dimension of the conductive plate parallel with a row is greater than the spacing between two openings in the row.

25. The connector of claim 20 wherein there are a plurality of said conductive plates and the additional receptacle is attached to two of the conductive plates.

* * * * *